US006688270B2

(12) United States Patent
Hisamoto et al.

(10) Patent No.: US 6,688,270 B2
(45) Date of Patent: Feb. 10, 2004

(54) APPARATUS AND METHOD FOR PREVENTING OVERRUN OF STARTER FOR ENGINE

(75) Inventors: Motoi Hisamoto, Tokyo (JP); Katsuyuki Sumimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 211 days.

(21) Appl. No.: 09/968,772

(22) Filed: Oct. 3, 2001

(65) Prior Publication Data

US 2002/0139338 A1 Oct. 3, 2002

(30) Foreign Application Priority Data

Mar. 30, 2001 (JP) ..... 2001-099632

(51) Int. Cl.[7] ..... F02N 11/08; F02N 17/00

(52) U.S. Cl. ..... 123/179.3; 290/38 R; 123/179.25; 123/179.28

(58) Field of Search ..... 123/179.21, 179.3, 123/179.14, 179.24, 179.25, 179.6, 179.7; 290/36 R, 38 R

(56) References Cited

U.S. PATENT DOCUMENTS 4,490,620 A * 12/1984 Hansen ..... 290/38 R
4,947,051 A * 8/1990 Yamamoto et al. ..... 290/38 R
6,024,065 A * 2/2000 Hojna et al. ..... 123/179.3
6,363,899 B1 * 4/2002 Koelle et al. ..... 123/179.3

FOREIGN PATENT DOCUMENTS

JP 2000-145599 5/2000 ..... F02N/11/08

* cited by examiner

*Primary Examiner*—Hieu T. Vo
*Assistant Examiner*—Johnny H. Hoang
(74) *Attorney, Agent, or Firm*—Sughrue Mion, PLLC

(57) ABSTRACT

A method and an apparatus for preventing overrun of an engine starter with high reliability by detecting accurately a state in which an engine operation has been started on the basis of a starter supply voltage to thereby protect the engine starter from excessive load and burnout while sparing extra interconnection or wiring for the starter.

8 Claims, 6 Drawing Sheets

APPARATUS AND METHOD FOR PREVENTING OVERRUN OF STARTER FOR ENGINE

BACKGROUND OF THE INVENTION

1. Field of the Invention

The present invention relates generally to a method and apparatus for controlling a starter which is used for starting operation of an engine such as, for example, an internal combustion engine for a motor vehicle, an automobile or the like. In more particular, the present invention is concerned with a method and apparatus for protecting or preventing the starter (hereinafter also referred to as the engine starter) from overrunning upon starting of the engine operation.

2. Description of Related Art

In general, upon starting operation of the engine which may be an internal combustion engine or other, the engine starter is manually controlled through manipulation of a key switch by a user or driver, and the starter is electrically deenergized, i.e., stopped, after confirmation of engine noise generated upon starting of operation of the engine.

However, in the case of motor vehicles such as buses and others in which a driver's seat is so distanced from the position at which the engine is installed that the engine starting noise is hard to hear or for other reasons such as acoustically low level of engine operation noise, noise generated after the engine operation has been started is difficult to recognize for the user. Consequently, there may unwantedly occur such situation in which the starter operation is continued over an extended time period notwithstanding of the fact that the engine operation has already been started, as a result of which an excessively large load is imposed on the starter.

Such being the circumstances, there have been proposed a variety of engine starting apparatuses and methods for automatically deenergizing or stopping the starter upon starting of engine operation with a view to protecting the starter from application of excessively large load, as is disclosed in a Japanese Patent Application Laid-Open Publication No. 145599/2000 (JP-A-12-145599) and others.

In the hitherto known or conventional apparatuses for preventing overrun of the starter as mentioned above, such arrangement is generally adopted that a starter power supply voltage (hereinafter also referred to simply as the starter supply voltage) is detected for automatically deenergizing or turning off the starter when the starter supply voltage has reached a predetermined reference voltage or alternatively the starter supply voltage exhibits a tendency of increasing continuously over a predetermined time period or duration.

In this conjunction, it is however noted that since the starter supply voltage is susceptible to variation in dependence on changes of the ambient temperature and the state of the power supply source, sufficient reliability can not be ensured for the detection of the starter supply voltage. As a result of this, such unwanted situation may arise that the starter is automatically turned off notwithstanding that the engine operation has not been started yet or the starter operation is continued regardless of the engine operation being started, giving rise to a problem.

Further, in another conventional apparatus, such arrangement is adopted that increasing of the engine rotation number (indicating starting of the engine operation) is detected on the basis of a relevant input signal supplied to an electronic control unit (ECU for short) or a voltage generated by an alternator to thereby turn off automatically the starter. In that case, however, extra expensiveness is involved for implementing the relevant circuit and interconnection for the starter, to disadvantage.

As is apparent from the foregoing, the conventional engine starter overrun preventing apparatuses and methods suffer problems. By way of example, in the case of the supply voltage detection apparatus disclosed in Japanese Patent Application Laid-Open Publication No. 145599/2000, reliability for detecting the starter supply voltage is low, as a result of which there undesirably arise the problems that the starter is possibly turned off before the engine operation is started or the starter operation is continued even after the engine operation has been started, incurring overrun (application of excess load) of the starter.

Further, in the apparatus for detecting the engine rotation number on the basis of the signal inputted to the ECU or the voltage generated by the alternator, additional circuit and interconnection with the starter is required, incurring extra expensiveness.

SUMMARY OF THE INVENTION

In the light of the state of the art described above, it is an object of the present invention to solve the problems of the conventional techniques described above and provide a method and an apparatus for preventing overrun of an engine starter with enhanced reliability by detecting accurately the state in which the engine operation has been started on the basis of the starter supply voltage to thereby protect the engine starter from excessive load and burnout due to the overrun even if the engine and the starter should fall into a locked state, while sparing extra interconnection or wiring for the starter.

In view of the above and other objects which will become apparent as the description proceeds, there is provided according to a first aspect of the present invention an apparatus for preventing overrun of an engine starter, which apparatus includes a voltage detecting means for measuring a supply voltage of the engine starter, a precedent starter voltage behavior storage means for storing a precedent voltage behavior of the supply voltage as a precedent starter voltage behavior, a current starter voltage behavior storage means for measuring a current voltage behavior of the supply voltage to thereby store the current voltage behavior as a current starter voltage behavior, an arithmetic means for reading out the current starter voltage behavior and the precedent starter voltage behavior to thereby arithmetically determine a voltage difference on the basis of difference between the current starter voltage behavior and the precedent starter voltage behavior, a comparison means for comparing the voltage difference with a predetermined voltage value, and a starter turn-off means for electrically deenergizing the engine starter upon detection on the basis of result of the comparison that a state in which the voltage difference remains short of the predetermined voltage value has continued for or longer than a predetermined time duration.

By virtue of the arrangement of the engine starter overrun preventing apparatus described above, the engine starter can be protected against overrun with enhanced reliability even in the case where the engine and the starter should fall into locked state, without need for additional expense for wiring/interconnection with the starter.

In a preferred mode for carrying out the invention, such arrangement may be adopted that the voltage waveform representing the precedent starter voltage behavior exhibits a phase difference less than one period relative to the voltage waveform representing the current starter voltage behavior.

With the arrangement described above, the state in which the engine operation has been started can distinctively be detected or recognized with high accuracy.

In another preferred mode for carrying out the invention, the arithmetic means may be so designed as to arithmetically determine a plurality of voltage differences on the basis of differences between the current starter voltage behavior and a plurality of the precedent starter voltage behaviors, respectively, which differ from one another in respect to the phase difference relative to the current starter voltage behavior. Further, the comparison means may be so designed as to compare the plurality of voltage differences, respectively, with the predetermined voltage value, while the starter turn-off means may be so designed as to electrically deenergize the engine starter when a state in which all of the above-mentioned voltage differences are short of the predetermined voltage value has continued for or longer than a predetermined time duration.

Owing to the arrangement described above, the state in which the engine operation has been started can distinctively be determined with high accuracy even if the period of the supply voltage should vary.

In yet another preferred mode for carrying out the invention, the precedent starter voltage behavior storage means may be comprised of a first precedent starter voltage behavior storage means for storing a first precedent starter voltage behavior which exhibits a first phase difference relative to the current starter voltage behavior, and a second precedent starter voltage behavior storage means for storing a second precedent starter voltage behavior which exhibits a second phase difference smaller than the first phase difference relative to the current starter voltage behavior, wherein the first precedent starter voltage behavior storage means may be designed to store the first precedent starter voltage behavior at a first sampling frequency, and the second precedent starter voltage behavior storage means may be designed to store the second precedent starter voltage behavior at a second sampling frequency which is higher than the first sampling frequency.

Owing to the arrangement described above, memory capacity for storing the starter voltage behaviors can be decreased.

Further, there is proposed according to a second aspect of the present invention, a method of preventing overrun of an engine starter by measuring a supply voltage for the engine starter to thereby electrically deenergize the engine starter when variation of the supply voltage makes disappearance. The above-mentioned method includes a first step of storing a precedent voltage behavior of the supply voltage as a precedent starter voltage behavior while measuring a current voltage behavior of the supply voltage to thereby store the current voltage behavior as a current starter voltage behavior, a second step of reading out the current starter voltage behavior and the precedent starter voltage behavior to thereby compare the current starter voltage behavior with the precedent starter voltage behavior, and a third step of electrically deenergizing the engine starter when a state in which a voltage difference arithmetically determined on the basis of difference between the current starter voltage behavior and the precedent starter voltage behavior remains short of a predetermined voltage value has continued for or longer than a predetermined time duration.

By virtue of the engine starter overrun preventing method described above, the engine starter can be protected against overrun with enhanced reliability even in the case where the engine and the starter should fall into locked state, without need for additional expense for wiring/interconnection with the starter.

In a mode for carrying out the second step of the method mentioned above, the current starter voltage behavior should preferably be compared with the precedent starter voltage behavior as read out which exhibits a phase difference less than one period relative to the current starter voltage behavior.

With the engine starter overrun preventing method described above, the state in which the engine operation has been started can distinctively be detected or recognized with high accuracy.

In another mode for carrying out the second step of the method mentioned above, the current starter voltage behavior should preferably be compared with a plurality of precedent starter voltage behaviors, respectively, which exhibit different phase differences, respectively, relative to the current starter voltage behavior.

Owing to the engine starter overrun preventing method described above, the state in which the engine operation has been started can distinctively be determined with high accuracy even if the period of the supply voltage should vary.

In yet another mode for carrying out the first step of the method mentioned above, the plurality of precedent voltage behaviors should preferably be sampled for storage with a plurality of sampling frequencies, respectively, which differ from each other.

Owing to the engine starter overrun preventing method described above, memory capacity for storing the starter voltage behaviors can be decreased.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
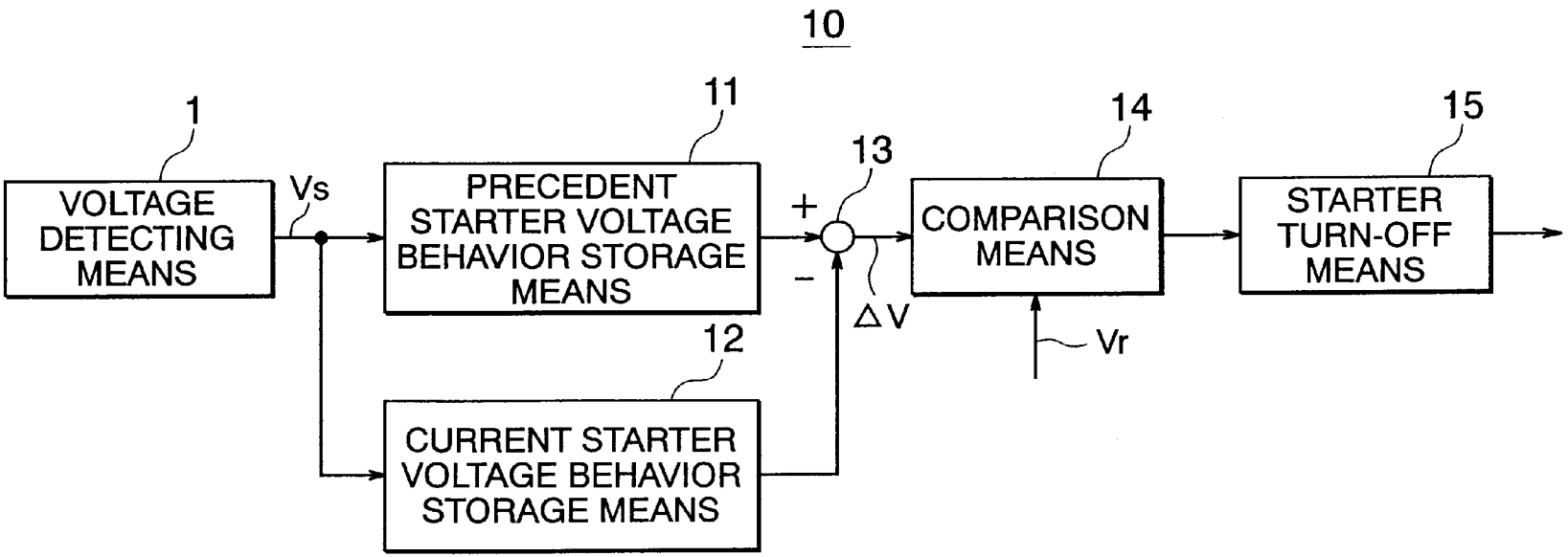
FIG. 1 is a block diagram showing generally and schematically a structure of an overrun preventing apparatus for an engine starter according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing generally and schematically a structure of an overrun preventing apparatus for an engine starter of e.g. a motor vehicle according to a first embodiment of the present invention.

Referring to FIG. 1, the engine starter overrun preventing apparatus according to the first embodiment of the invention includes a voltage detecting means 1 which is provided in association with a starter power supply circuit (not shown) is designed for measuring a starter supply voltage Vs. The output signal of the voltage detecting means 1 is inputted to an electronic control unit or ECU 10 which may be constituted by a microcomputer or microprocessor.

The ECU 10 is comprised of a precedent starter voltage behavior storage means 11, a current starter voltage behavior storage means 12, a subtraction means 13 which may also be referred to as the arithmetic means in more general sense, a predetermined voltage generation means (not shown), a comparison means 14 and a starter turn-off means 15.

The precedent starter voltage behavior storage means 11 is designed for storing the behavior of the starter supply voltage Vs in the past as the precedent starter voltage behavior, while the current starter voltage behavior storage means 12 is designed to measure the current starter supply voltage Vs to thereby store or hold the measured values as the current starter voltage behavior.

The arithmetic or subtraction means 13 is so designed or programmed to read the current starter voltage behavior and the precedent starter voltage behavior from the precedent starter voltage behavior storage means 11 and the current starter voltage behavior storage means 12, respectively, to arithmetically determine a voltage difference ΔV between the current starter voltage and the precedent starter voltage derived from the respective voltage behavior (i.e., |precedent starter voltage−current starter voltage|).

The comparison means 14 is designed to compare the voltage difference ΔV with a predetermined voltage value Vr to output as a result of the comparison a signal indicative of the state in which the voltage difference ΔV does not exceeds the predetermined voltage value Vr.

The predetermined voltage value Vr generated by the predetermined voltage generation means (not shown) is previously set in dependence on the engine specifications and the phase difference between the current starter voltage behavior and the precedent starter voltage behavior so that erroneous recognition or detection can be evaded.

Finally, the starter turn-off means 15 is so designed or programmed as to output a command signal for electrically deenergizing or turning off the starter to the starter power supply circuit in response to the output signal of the comparison means 14 which indicates that the state where the voltage difference ΔV is short of the predetermined voltage value Vr has continued for or longer than a predetermined time period.

Figure 2:
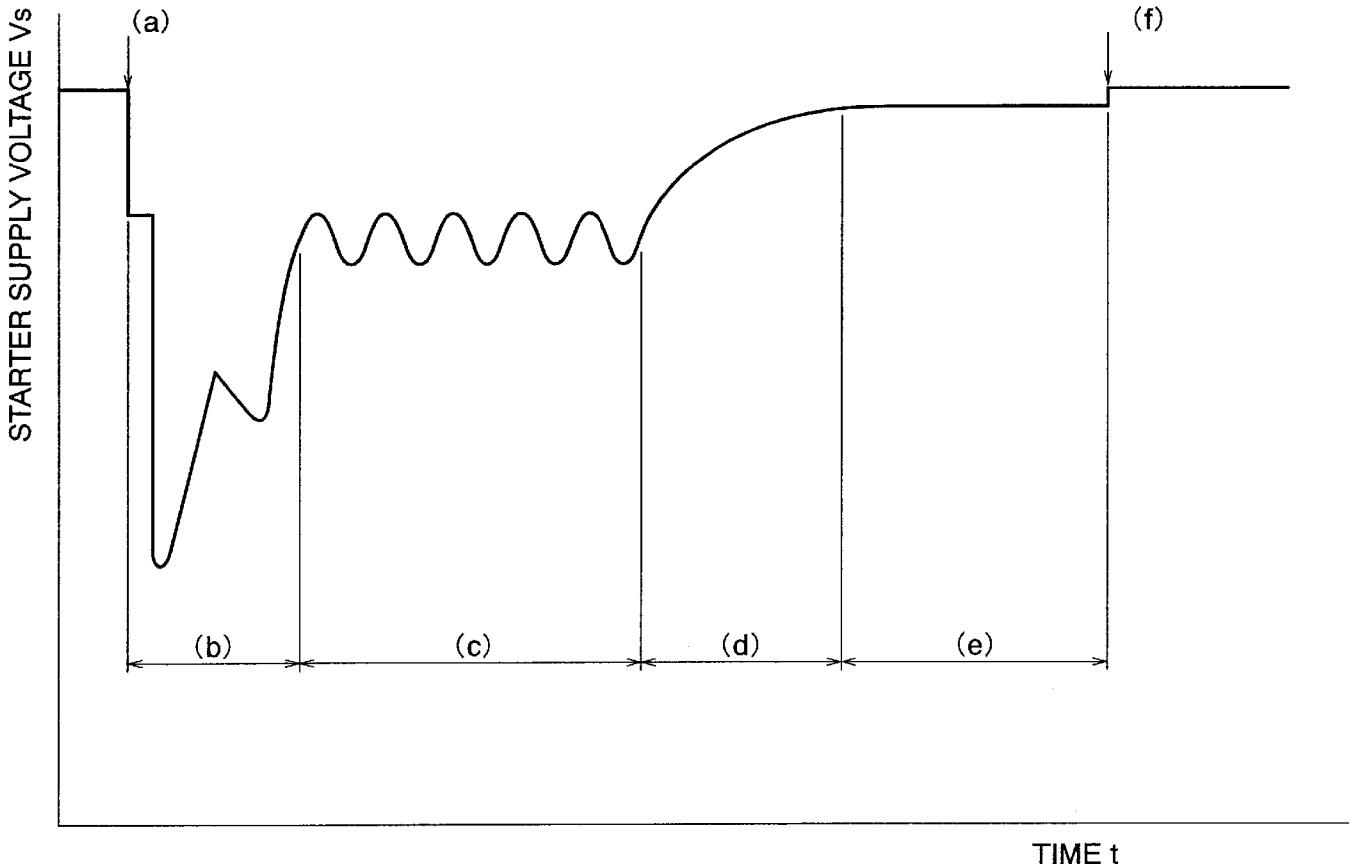
FIG. 2 is a waveform diagram for illustrating a time-dependent change of a starter supply voltage in the engine starter overrun preventing apparatus according to the first embodiment of the present invention.

Next, referring to FIGS. 2 and 3, description will be made of operation of the engine starter overrun preventing apparatus according to the first embodiment of the present invention shown in FIG. 1. FIG. 2 is a waveform diagram showing a behavior of the starter supply voltage Vs in general upon starting of the engine operation, wherein the time is taken along the abscissa while the starter supply voltage Vs is taken along the ordinate. More specifically, illustrated in FIG. 2 are changes of the starter supply voltage Vs in intervals or subperiods (b) to (e) intervening between a starter-on time point (a) and a starter-off time point (f).

In the following, change behavior in general of the starter supply voltage Vs will be elucidated by reference to FIG. 2.

When a user or driver manipulates a key switch to a starter-on position at the starter-on time point (a), a starter magnet switch is closed. As a result of this, a large current (rush current) flows instantaneously to the starter. Consequently, the starter supply voltage Vs lowers rapidly and steeply at the starter-on time point (a), as can be seen in the figure.

In the interval or subperiod (b), a pinion gear is caused to mesh with a ring gear of the engine as a result of closing of the starter magnet switch, whereon a motor shaft of the starter starts to rotate. Consequently, the current fed to the starter diminishes gradually while the starter supply voltage Vs increases correspondingly.

When the state in which engine is rotated by the starter (i.e., cranking state) has been realized in the interval or subperiod (c), engine torque will change in correspondence to the compression stroke and the expansion stroke, as a result of which waveform of the starter supply voltage Vs changes periodically similarly to the change of the engine torque.

When the engine operation is started in the interval or subperiod (d), the load imposed on the starter decreases owing to the torque generated by the engine, which results in that the starter supply voltage Vs increases.

Thereafter, when the state in which the pinion gear of the starter meshes with the ring gear of the engine remains as it is regardless of the engine operation has been started (this state is referred to as the overrun state), the starter assumes no-load state (i.e., the state in which no load is imposed to the starter). As a result, the starter supply voltage Vs continues to remain constant.

Finally, when the key switch is set to the starter-off position in the interval or subperiod (f), the power supply to the starter is intercepted, whereby the starter supply voltage Vs is restored to the initial value or level prevailed before the engine stating operation described above.

According to the teachings of the present invention incarnated in the first embodiment thereof, such arrangement is adopted that the power supply to the starter is automatically broken when the interval or subperiod (d) corresponding to the engine operation start state or the interval or subperiod (e) corresponding to the overrun state has been reached, even if the key switch is at the starter-on position (i.e., even if the key switch is closed. By virtue of the arrangement mentioned above, the meshing state of the ring gear of the engine and the pinion gear of the starter is cleared, whereby the starter can be protected against application of an excessively heavy load.

In the following, basic operation underlying the starter overrun preventing apparatus according to the first embodiment of the present invention will be described by reference to FIG. 3.

Figure 3:
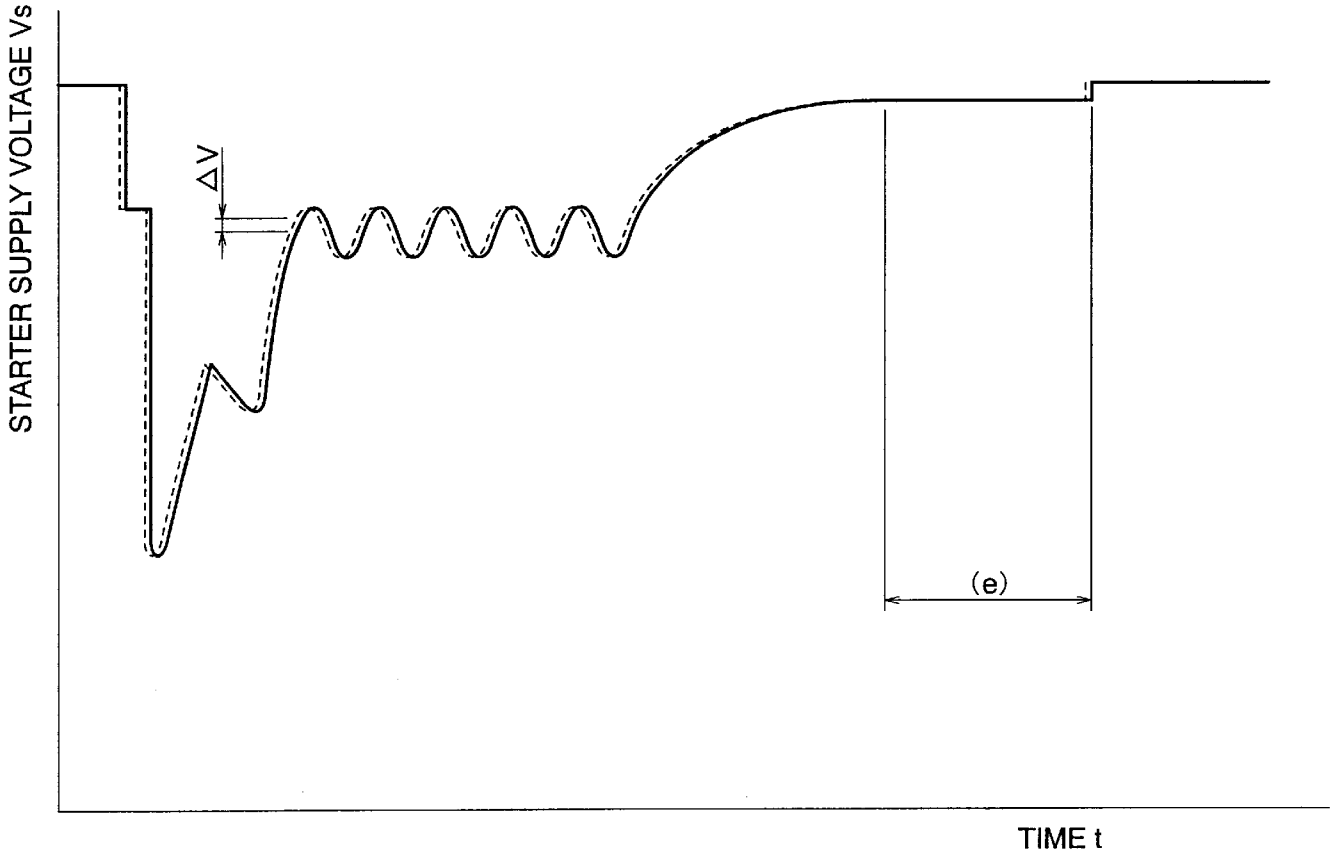
FIG. 3 is a waveform diagram which shows time-dependent changes of starter supply voltages for illustrating a method of preventing overrun of an engine starter according to the first embodiment of the present invention.

FIG. 3 is a waveform for illustrating the principle underlying the starter overrun preventing method according to the first embodiment of the present invention, wherein a current starter voltage behavior (see a solid line curve) and a precedent starter voltage behavior (see a broken line curve) are shown to be compared with each other.

At this juncture, it is presumed that the voltage difference ΔV between the current starter voltage and the precedent starter voltage is constantly detected by the arithmetic or subtraction means 13 incorporated in the ECU 10.

The precedent starter voltage behavior storage means 11 and the current starter voltage behavior storage means 12 are designed to measure the precedent and current starter supply voltages Vs, respectively, at a predetermined frequency to thereby store the sampled values as the precedent starter voltage behavior (see a broken line curve) and the current starter voltage behavior (see a solid line curve), respectively.

Subsequently, the subtraction means 13 reads out the precedent starter voltage behavior (broken line curve) and the current starter voltage behavior (solid line curve) to arithmetically determine the voltage difference ΔV between the precedent starter voltage and the current starter voltage derived, respectively, from the voltage behaviors as read out.

In that case, the phase difference between the current starter voltage behavior and the precedent starter voltage behavior is so set as not to exceed one period of change of the voltage waveform of the starter supply voltages in the cranking state in the interval or subperiod (c) shown in FIG. 2.

As is shown in FIG. 2 in the interval or subperiod (c), the starter supply voltage Vs changes periodically so long as the engine is in the cranking state, which brings about a significant deviation between the phase of the current starter voltage behavior and that of the precedent starter voltage behavior. Consequently, the voltage difference ΔV is relatively large, as can be seen in the figure.

In succession, when the engine operation starts and enters the idling state, the starter then assumes the overrun state with the starter supply voltage Vs becoming constant, as shown at (e) in FIG. 3, which means that the voltage difference ΔV between the current starter voltage and the precedent starter voltage disappears.

Thus, the ECU 10 can determine distinctively whether or not the cranking state of the engine or the overrun state of the starter is prevailing by comparing the voltage difference ΔV with the predetermined voltage value Vr. More specifically, when the voltage difference ΔV is not smaller than the predetermined voltage value Vr, the ECU 10 decides that the engine is in the cranking state, being driven by the starter (i.e., the interval or subperiod (c)), to thereby allow the on-state of the starter to continue.

On the other hand, when the voltage difference ΔV is not greater than the predetermined voltage value Vr, the starter overrun state in which the engine operation has been started (the interval or subperiod (e)) is decided. Thus, the off-control of the starter is immediately put into effect.

In this way, by comparing the current starter voltage behavior with the precedent starter voltage behavior which exhibits the phase difference relative to the current starter voltage behavior and by determining the engine operation start state at the time point when the state in which the voltage difference ΔV is sufficiently small has continued for a sufficient duration, it is possible to stop automatically the operation of the starter with high reliability.

By virtue of the feature described above, the burnout of the starter can be prevented without fail even when the engine or the starter should be in the locked state.

Besides, since there is no necessity of detecting the input signal to the ECU 10 or the voltage generated by the alternator for making decision as to the engine operation start state, any extra expense for wiring/interconnection for the starter is not required, advantageously from the standpoint of the cost.

Embodiment 2

In the foregoing description of the overrun preventing apparatus for the engine starter according to the first embodiment of the invention, no consideration has been paid to variations of the periods of rotation of the starter and the engine. A second embodiment of the present invention is directed to the engine starter overrun preventing apparatus which is arranged such that in consideration of the variation of the rotation period mentioned above, a plurality of precedent starter voltages exhibiting different phase differences, respectively, relative to the current starter voltage are referenced to thereby make decision as to the start of the engine operation on the basis of plural voltage differences.

In the following, referring to FIGS. 4 to 9, description will be made of the engine starter overrun preventing method and apparatus designed to cope with the variation of the periods of rotation of the starter and the engine according to the second embodiment of the present invention.

Figure 4:
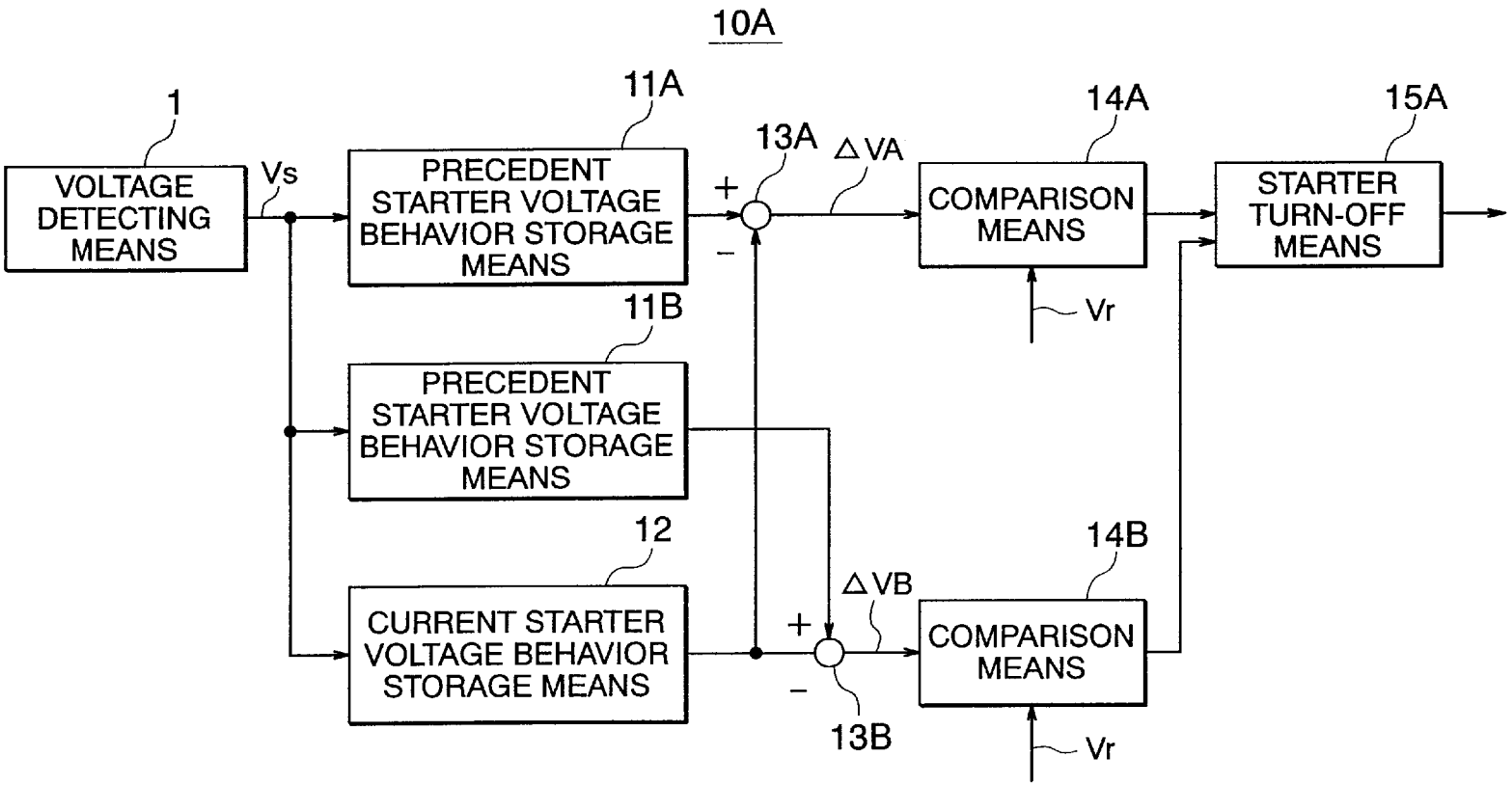
FIG. 4 is a block diagram showing generally and schematically a structure of an overrun preventing apparatus for an engine starter according to a second embodiment of the present invention.

FIG. 4 is a block diagram showing generally and schematically a structure of the engine starter overrun preventing apparatus according to the second embodiment of the present invention. In the figure, like components as those described hereinbefore by reference to FIG. 1 are denoted by like reference symbols, being affixed with "A" as the case may be, and repeated description in detail thereof is omitted.

Referring to FIG. 4, an electronic control unit 10A is comprised of two parallel channels, i.e., a first channel which includes a precedent starter voltage behavior storage means 11A, an arithmetic or subtraction means 13A and a comparison means 14A and a second channel which includes a precedent starter voltage behavior storage means 11B, an arithmetic or subtraction means 13B and a comparison means 14B. Although the two-channel arrangement is presumed, it goes without saying that three or more channels may be provided in parallel.

In the instant embodiment of the invention, the precedent starter voltage behavior storage means 11A and the precedent starter voltage behavior storage means 11B are designed to save and store two species of precedent starter voltage behaviors, respectively, which exhibit mutually different phase differences relative to the current starter voltage behavior. Further, the arithmetic or subtraction means 13A and 13B are designed to read out mutually different precedent starter voltage behaviors from the precedent starter voltage behavior storage means 11A and 11B, respectively, to thereby arithmetically determine the voltage differences ΔVA and ΔVB between the current starter supply voltage and the precedent starter supply voltages, respectively.

The comparison means 14A compares the voltage difference ΔVA with the predetermined voltage value Vr while the comparison means 14B compares the voltage difference ΔVB with the predetermined voltage value Vr. The starter turn-off means 15A is designed to supply to the starter power supply circuit a command signal for turning off (i.e., electrically deenergizing) the engine starter when the state in which both the voltage differences ΔVA and ΔVB are smaller than the predetermined voltage value Vr has continued over a predetermined time duration.

Furthermore, the precedent starter voltage behavior storage means 11A and 11B are designed to save and store the precedent starter voltage behaviors at mutually different sampling frequencies, respectively, as will be described hereinafter.

In the following, operation of the engine starter overrun preventing apparatus according to the second embodiment of the invention will be described by reference to FIGS. 5 to 9 while taking into consideration of variation of the period of rotation of the starter.

In general, the waveform of the starter supply voltage Vs varies in dependence on the ambient temperature in the interval or subperiod (c) shown in FIG. 1. Accordingly, some measures for coping with the change of the ambient temperature has to be taken.

Figure 5:
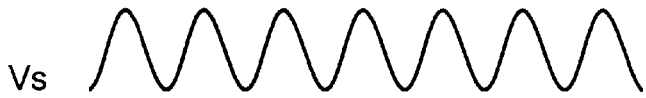
FIG. 5 is a waveform diagram showing a time-dependent variation of a high-frequency component of the starter supply voltage in the engine starter overrun preventing apparatus according to the second embodiment of the present invention.
Figure 6:
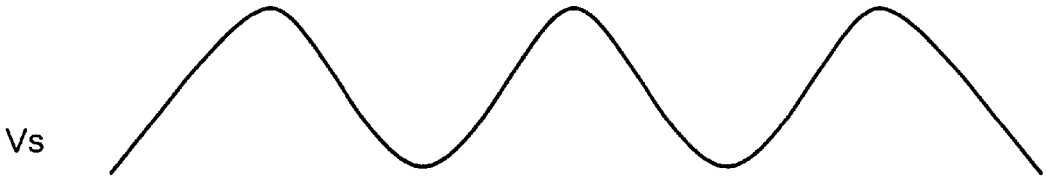
FIG. 6 is a waveform diagram showing a time-dependent variation of a low-frequency component of the starter supply voltage in the engine starter overrun preventing apparatus according to the second embodiment of the present invention.

FIGS. 5 to 8 are waveform diagrams for illustrating changes of the starter supply voltage Vs in the interval or subperiod (c), wherein FIG. 5 shows the case where the cranking rotation number is relatively large, and FIG. 6 shows the case where the cranking rotation number is relatively small.

Figure 7:
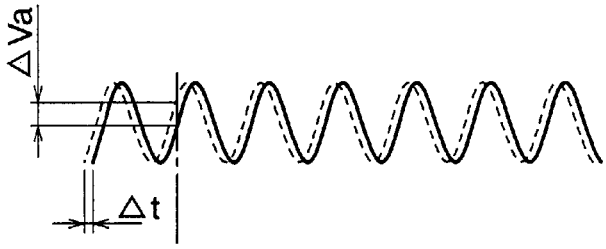
FIG. 7 is a waveform diagram showing time-dependent variations of the high-frequency components of the starter supply voltages, respectively, for illustrating a method of preventing overrun of the engine starter according to the second embodiment of the present invention.
Figure 8:
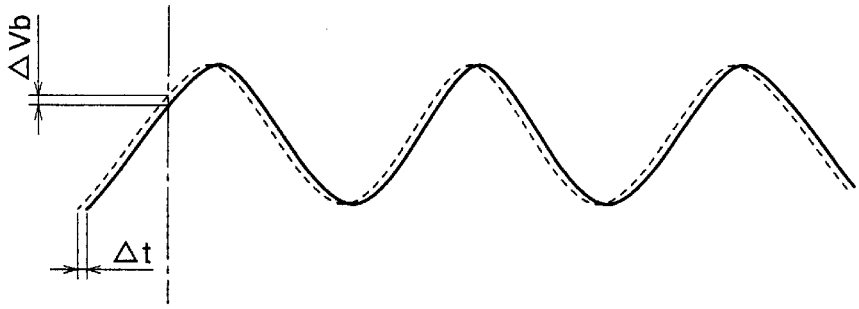
FIG. 8 is a waveform diagram showing time-dependent variations of the low-frequency components of the starter supply voltages, respectively, for illustrating the method of preventing overrun of the engine starter according to the second embodiment of the present invention.

Further, FIG. 7 shows the voltage difference ΔVa in the case where the cranking rotation number is relatively large while FIG. 8 shows the voltage difference ΔVb in the case where the cranking rotation number is relatively small. In both the cases shown in FIGS. 7 and 8, it is presumed that the phase difference Δt between the current starter supply voltage behavior (solid line curve) and the precedent voltage historical data (broken line curve) remains essentially constant independent of the variation of the waveform of the supply voltage.

By way of example, as the ambient temperature rises, the cranking rotation number increases as well. Consequently, the engine cranking torque decreases. As a result of this, the frequency of variation of the starter supply voltage becomes high in the interval or subperiod (c), as a result of which the period of variation of the starter supply voltage becomes short, as is illustrated in FIG. 5.

On the contrary, as the ambient temperature becomes low, the cranking rotation number decreases. Consequently, the engine cranking torque increases. As a result of this, the frequency of variation of the starter supply voltage Vs becomes low in the interval or subperiod (c), (as a result of which the period of variation of the starter supply voltage Vs becomes long), as can be seen in FIG. 6.

In the state mentioned above, it becomes difficult to take into consideration all the ambient temperatures in the interval or subperiod (c) (i.e., in the cranking state) through the comparison of the single precedent starter voltage behavior with the current starter voltage behavior as described hereinbefore in conjunction with the first embodiment of the invention.

More specifically, when the ambient temperature of the engine is high (i.e., when the frequency of the starter supply voltage Vs is high), the voltage difference ΔVa between the precedent starter voltage behavior and the current starter voltage behavior becomes relatively large, as can be seen in FIG. 7.

On the other hand, when the ambient temperature of the engine is low (i.e., when the frequency of the starter supply voltage Vs is low), the voltage difference ΔVb between the precedent starter voltage behavior and the current starter voltage behavior becomes relatively small, as can be seen in FIG. 8.

At this juncture, let's assume that only the voltage difference ΔVb in the state where the period of the waveform of the supply voltage is long (see FIG. 8) is compared with the predetermined voltage value Vr. Then, there may arise such unwanted situation that the starter is turned off before the engine starts to rotate in the cranking state because of erroneous detection or decision that the voltage difference between the precedent starter voltage and the current starter voltage has disappeared.

For the reason described above, the ECU 10A of the the engine starter overrun preventing apparatus according to the instant embodiment of the invention is so designed or programmed to compare a plurality of voltage differences between the current starter voltages and a plurality (two in the illustrated case) of precedent starter voltages with the predetermined voltage value Vr, whereon the state in which variation of the waveform of the starter supply voltage is mitigated is decided on the basis of the logical product of the results of comparison to thereby prevent the erroneous recognition or determination mentioned above.

Figure 9:
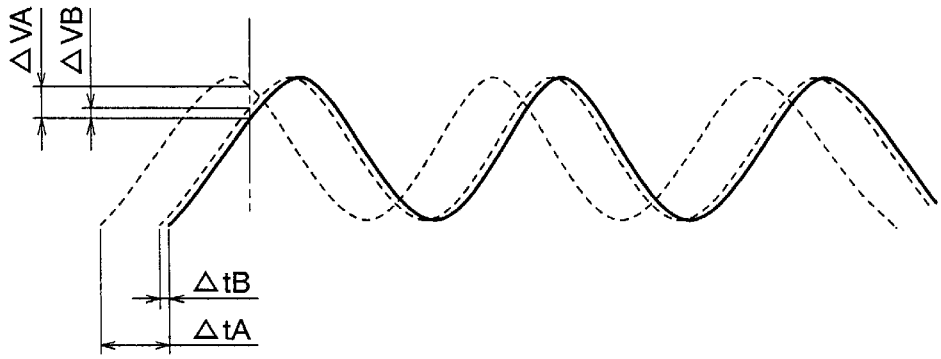
FIG. 9 is a waveform diagram showing time-dependent variations of the low-frequency components of the starter supply voltages, respectively, for illustrating the method of preventing overrun of the engine starter according to the second embodiment of the present invention.

FIG. 9 is a waveform diagram for illustrating a method of preventing overrun of the engine starter according to the second embodiment of the invention in the case where the frequency of variation of the waveform of the supply voltage is low (i.e., the case where erroneous decision or recognition is likely to occur). In FIG. 9, the current starter voltage behavior is indicated by a solid line curve with two different current starter voltage behaviors being indicated by broken waveforms, respectively.

The two different precedent starter voltage behaviors shown in FIG. 9 are stored on the precedent starter voltage behavior storage means 11A and 11B, respectively, shown in FIG. 4. By way of example, the precedent starter voltage behavior storage means 11A stores therein the precedent starter voltage behavior exhibiting a large phase difference ΔtA relative to the current starter voltage behavior (i.e., the precedent starter voltage behavior before a relatively long time from the current starter voltage behavior) while the other precedent starter voltage behavior storage means 11B stores therein the precedent starter voltage behavior exhibiting a small phase difference ΔtB relative to the current starter voltage behavior (i.e., immediately before the current starter voltage behavior).

Accordingly, when the waveform of the starter supply voltage is varying as illustrated in FIG. 9, the voltage differences ΔVA and ΔVB determined arithmetically by the subtraction means 13A and 13B bear such relation that the voltage difference ΔVA for the larger phase difference ΔtA is greater than the voltage difference ΔVB for the smaller phase difference ΔtB.

More specifically, when compared with the current starter voltage behavior (see a solid line curve in FIG. 9), the voltage difference ΔVB of the precedent starter voltage immediately preceding to the current starter voltage is small, whereas the voltage difference ΔVA of the precedent starter voltage preceding to the current starter voltage by a relatively long time is large.

The starter turn-off means 15A turns off, i.e., electrically deenergizes, the starter when both the voltage differences ΔVA and ΔVB decrease smaller than the predetermined voltage value Vr, as decided on the basis of the result of comparison of the predetermined voltage value Vr with the voltage differences ΔVA and ΔVB, respectively.

In this conjunction, it should be noted that even when the voltage difference ΔVB for the smaller phase difference ΔtB is smaller than the predetermined voltage value Vr, the starter is not turned off by the starter turn-off means 15A because it is decided that the start of the engine operation is erroneously detected so long as the voltage difference ΔVA for the large phase difference ΔtA is greater than the predetermined voltage value Vr.

As can now be appreciated from the above, by virtue of the arrangement that when both the voltage differences ΔVA and ΔVB of the two precedent voltages relative to the current starter voltage are lower than the predetermined voltage value Vr, the starter is electrically deenergized, i.e., turned off. Thus, the turning-off of the starter based on erroneous detection or recognition of the start of the engine operation can positively be prevented.

To say in another way, by making use of the results of comparisons based on a plurality of precedent starter voltage behaviors, the result of the decision as to whether variation of the starter supply voltage Vs becomes mitigated can be made independent of the ambient temperature and the condition of the power source, whereby the starter turn-off means 15A is capable of detecting distinctively the engine operation start state with high accuracy.

Incidentally, when the sampling frequency for measuring the current starter voltage is set at a relatively high frequency with a view to enhancing the accuracy of the voltage behaviors, a greater memory capacity is required for the precedent starter voltage behavior storage means 11A in order to store the precedent starter voltage behavior exhibiting a large phase difference ΔtA relative to the current starter voltage behavior.

Accordingly, for the precedent starter voltage behavior storage means 11A, a lower sampling frequency should preferably be set for the precedent starter voltage behavior storage means 11A as compared with the sampling frequency for the current starter voltage behavior storage means 12 and the precedent starter voltage behavior storage means 11B for measuring the starter voltage behavior.

In other words, for the precedent starter voltage behavior storage means 11A destined for storing the precedent starter voltage behavior exhibiting the large phase difference ΔtA, the sampling frequency should preferably be set relatively small, while for the precedent starter voltage behavior storage means 11B destined for storing the precedent starter voltage behavior exhibiting the small phase difference ΔtB, the sampling frequency should preferably be set relatively large. Then, the memory capacity to be implemented in the ECU 10A can be saved while ensuring high accuracy for the measurements.

Furthermore, it is well known that in the locked state of the engine or the starter, a large current comparable to the rush current will unwantedly continue to flow, incurring burnout of the starter to a great disadvantage. In that case, however, the starter supply voltage Vs becomes lower with the variation of voltage level making disappearance. Accordingly, by turning off the starter by detecting the state in which variation of the waveform of the supply voltage has disappeared, duration of the locked state over an extended period can be evaded, whereby the starter can be protected against the burnout with high reliability.

Many features and advantages of the present invention are apparent from the detailed description and thus it is intended by the appended claims to cover all such features and advantages which fall within the true spirit and scope of the invention. Further, since numerous modifications and combinations will readily occur to those skilled in the art, it is not intended to limit the invention to the exact construction and operation illustrated and described.

By way of example, although the present invention has been described on the presumption that the invention is applied to protection of the starter for the engine such as the internal combustion engine for a motor vehicle, it should be appreciated that the invention can find application to other types of engines whose operation is started with the aid of the starter. Accordingly, the term "engine" used herein should never be interpreted in the strict sense.

Accordingly, all suitable modifications and equivalents may be resorted to, falling within the spirit and scope of the invention.

What is claimed is:

1. An apparatus for preventing overrun of an engine starter, comprising:

voltage detecting means for measuring a supply voltage of said engine starter;

previous starter voltage behavior storage means for storing a previous voltage behavior of said supply voltage as a previous starter voltage behavior;

current starter voltage behavior storage means for measuring a current voltage behavior of said supply voltage to thereby store said current voltage behavior as a current starter voltage behavior;

arithmetic means for reading out said current starter voltage behavior and said previous starter voltage behavior to thereby arithmetically determine a voltage difference on a basis of a difference between said current starter voltage behavior and said previous starter voltage behavior;

comparison means for comparing said voltage difference with a predetermined voltage value; and starter turn-off means for electrically deenergizing said engine starter upon detecting, on the basis of said comparison, that a state in which voltage difference remains less than said predetermined voltage value has continued for at least a predetermined time duration.

2. The overrun preventing apparatus according to claim 1, wherein a first voltage waveform representing said previous starter voltage behavior exhibits a phase difference less than one period relative to a second voltage waveform representing said current starter voltage behavior.

3. The overrun preventing apparatus according to claim 1, wherein said arithmetic means arithmetically determines a plurality of voltage differences on the basis of differences between said current starter voltage behavior and a plurality of the previous starter voltage behaviors, respectively, which differ from one another in respect to a phase difference relative to said current starter voltage behavior;

wherein said comparison means compares said plurality of voltage differences, respectively, with said predetermined voltage value; and wherein said starter turn-off means electrically deenergizes said engine starter when a state in which all of said plurality of voltage differences are less than said predetermined voltage value has continued for at least a predetermined time duration.

4. The overrun preventing apparatus according to claim 3, wherein said previous starter voltage behavior storage means includes:

first previous starter voltage behavior storage means for storing a first previous starter voltage behavior which exhibits a first phase difference relative to said current starter voltage behavior; and second previous starter voltage behavior storage means for storing a second previous starter voltage behavior which exhibits a second phase difference smaller than said first phase difference relative to said current starter voltage behavior;

wherein said first previous starter voltage behavior storage means stores said first previous starter voltage behavior at a first sampling frequency; and wherein said second previous starter voltage behavior storage means stores said second previous starter voltage behavior at a second sampling frequency which is higher than said first sampling frequency.

5. A method of preventing overrun of an engine starter by measuring a supply voltage for said engine starter to thereby electrically deenergize said engine starter when variation of said supply voltage remains less than a predetermined voltage value for at least a predetermined time duration, comprising:

a first step of storing a previous voltage behavior of said supply voltage as a previous starter voltage behavior, while measuring a current voltage behavior of said supply voltage to thereby store said current voltage behavior as a current starter voltage behavior;

a second step of reading out said current starter voltage behavior and said previous starter voltage behavior to thereby compare said current starter voltage behavior with said precedent starter voltage behavior; and a third step of electrically deenergizing said engine starter when a state in which a voltage difference arithmetically determined on a basis of difference between said current starter voltage behavior and said previous starter voltage behavior remains less than said predetermined voltage value has continued for at least said predetermined time duration.

6. The method of preventing overrun according to claim 5, wherein in said second step, said current starter voltage behavior is compared with said previous starter voltage behavior which exhibits a phase difference less than one period relative to said current starter voltage behavior.

7. The method of preventing overrun according to claim 5, wherein in said second step, said current starter voltage behavior is compared with a plurality of previous starter voltage behaviors, respectively, which exhibit different phase differences, respectively, relative to said current starter voltage behavior.

8. The method of preventing overrun according to claim 7, wherein in said first step, said plurality of previous voltage behaviors are sampled for storage with a plurality of sampling frequencies, respectively, which differ from each other.

* * * * *